US010568424B2

(12) United States Patent
Meusburger et al.

(10) Patent No.: US 10,568,424 B2
(45) Date of Patent: Feb. 25, 2020

(54) DRAWER PULL-OUT GUIDE

(71) Applicant: Julius Blum GmbH, Hoechst (AT)

(72) Inventors: Marc Meusburger, Egg (AT); Hermann Haemmerle, Lustenau (AT); Pascal Berchtold, Alberschwende (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 16/377,801

(22) Filed: Apr. 8, 2019

(65) Prior Publication Data

US 2019/0231070 A1 Aug. 1, 2019

Related U.S. Application Data

(63) Continuation of application No. PCT/AT2017/060189, filed on Jul. 26, 2017.

(30) Foreign Application Priority Data

Oct. 28, 2016 (AT) ..... A 50995/2016

(51) Int. Cl.
*A47B 88/00* (2017.01)
*A47B 88/407* (2017.01)
(Continued)

(52) U.S. Cl.
CPC ..... *A47B 88/407* (2017.01); *A47B 88/487* (2017.01); *A47B 88/493* (2017.01); *A47B 2210/0059* (2013.01)

(58) Field of Classification Search
CPC ..... A47B 88/473; A47B 88/493; A47B 2210/0018; A47B 88/423; A47B 88/40;
(Continued)

(56) References Cited

U.S. PATENT DOCUMENTS 3,449,033 A * 6/1969 Pipe ..... F16C 29/04 312/334.11
4,465,324 A * 8/1984 Rock ..... A47B 88/487 384/19

(Continued)

FOREIGN PATENT DOCUMENTS

AT 398 519 12/1994
AT 007 446 4/2005

(Continued)

OTHER PUBLICATIONS

CN 203041349 Wu Z abstract and figure (Year: 2013).*

(Continued)

*Primary Examiner* — Janet M Wilkens
(74) *Attorney, Agent, or Firm* — Wenderoth, Lind & Ponack, L.L.P.

(57) ABSTRACT

A drawer pull-out guide includes a fastening portion having a vertical limb and a transverse limb protruding from the vertical limb. The transverse limb is connected to a limb of the carcass rail, an extension rail is displaceably supported relative to the carcass rail, and a rolling body is arranged between the carcass rail and the extension rail and is supported on a running limb of the carcass rail and/or the extension rail. The limb of the carcass rail has a first limb portion connected to the transverse limb. A second limb portion of the carcass rail, in an unloaded condition of the drawer pull-out guide, is spaced from the transverse limb by a gap, and can be tilted or bent towards the transverse limb. Therefore, a change of relative position between the running limb and the rolling body can be compensated for, and the gap can be reduced.

13 Claims, 6 Drawing Sheets

(51) Int. Cl.
*A47B 88/487* (2017.01)
*A47B 88/493* (2017.01)

(58) Field of Classification Search
CPC ..... A47B 88/44; A47B 88/443; A47B 88/447; A47B 88/49; A47B 2210/0016; A47B 2210/0059; A47B 2210/0081
USPC ..... 312/334.1, 334.7, 334.8, 334.6, 330.1, 312/334.24, 334.25, 349, 350, 270.3, 312/334.9, 334.26, 334.31, 334.33, 312/334.44, 334.12, 334.14, 334.27, 312/334.28
See application file for complete search history.

(56) References Cited

U.S. PATENT DOCUMENTS

| | | | | | |
|---|---|---|---|---|---|
| 4,659,237 | A | | 4/1987 | Rapp | |
| 4,779,999 | A | | 10/1988 | Lautenschläger | |
| 4,955,160 | A | | 9/1990 | Röck | |
| 5,641,216 | A | * | 6/1997 | Grass | A47B 88/483 312/334.27 |
| 5,722,749 | A | * | 3/1998 | Domenig | A47B 88/437 312/334.4 |
| 5,882,100 | A | * | 3/1999 | Rock | A47B 88/493 312/334.34 |
| 9,332,840 | B2 | * | 5/2016 | Horii | A47B 88/493 |
| 9,756,941 | B1 | * | 9/2017 | Rowland | A47B 88/40 |
| 10,085,558 | B2 | * | 10/2018 | Klaus | A47B 88/427 |
| 2009/0195131 | A1 | * | 8/2009 | Chi | A47B 88/467 312/319.1 |
| 2011/0109214 | A1 | | 5/2011 | Lam et al. | |

FOREIGN PATENT DOCUMENTS

| | | | |
|---|---|---|---|
| CA | 2280376 | * | 2/2000 |
| DE | 731 207 | | 2/1943 |
| DE | 30 44 884 | | 7/1982 |
| DE | 3822575 | * | 1/1989 |
| DE | 10 2014 119 729 | | 6/2016 |
| EP | 0 363 583 | | 4/1990 |
| EP | 2 322 057 | | 5/2011 |
| GB | 2 168 597 | | 6/1986 |
| WO | 2017000003 | * | 1/2017 |
| WO | 2017106889 | * | 6/2017 |

OTHER PUBLICATIONS

International Search Report dated Nov. 7, 2017 in International (PCT) Application No. PCT/AT2017/060189.
Search Report dated May 9, 2017 in Austrian Application No. A 50995/2016, with English translation.

* cited by examiner

DRAWER PULL-OUT GUIDE

BACKGROUND OF THE INVENTION

The present invention relates to a drawer pull-out guide, including a carcass rail to be fixed to a furniture carcass, and a fastening portion for fixing the carcass rail to the furniture carcass.

The fastening portion has a vertical limb configured to rest against the furniture carcass, and a transverse limb protruding from the vertical limb, and the transverse limb of the fastening portion is connected to a limb of the carcass rail, the limb of the carcass rail extending in a longitudinal direction of the carcass rail.

An extension rail is displaceably supported relative to the carcass rail in the longitudinal direction, and a rolling body is arranged between the carcass rail and the extension rail.

The rolling body is configured to be supported on a running limb of the carcass rail and/or on a running limb of the extension rail.

Drawer pull-out guides are usually fixed to opposing side walls of a furniture carcass and enable a low-frictional movement of the drawer, in particular when the drawer is heavily loaded. When the drawer bottom of the drawer is considerably loaded by storage items, there is frequently the problem that the extension rail, due to this loading, is tilted about an axis extending in the longitudinal direction relative to the carcass rail and is therewith also tilted to those rolling bodies which are provided between the carcass rail and the extension rail for load-transmitting purposes. When the extension rail additionally includes a support portion for a drawer bottom, the lateral tilting moment acting on the extension rail is additionally increased by the loading of the drawer. The tilting movement of the extension rail leads to a premature and uneven wear of the rolling bodies, so that the functionality of the drawer pull-out guide is adversely affected.

It is an object of the present invention to propose a drawer pull-put guide of the type mentioned in the introductory part, thereby avoiding the above drawback.

SUMMARY OF THE INVENTION

To achieve the above object, the limb of the carcass rail has a first limb portion and at least one second limb portion. The first limb portion is connected to the transverse limb of the fastening portion, and the second limb portion, upon a load of the extension rail about an axis extending in the longitudinal direction, can be tilted or bent in a direction towards the transverse limb. Therefore, a change of the relative position between the running limb and the rolling body, caused by a load of the extension rail in a direction transverse to the longitudinal direction, can be at least partially compensated.

In other words, a compensating device is provided by which the carcass rail, upon a static or a dynamic loading of the extension rail, can be tilted or bent relative to the transverse limb of the fastening portion about an axis extending in the longitudinal direction of the drawer pull-out guide. In this way, the running limb and the rolling body, independent from the loading condition of the drawer, rest against each other substantially without tilting, i.e. despite the loading, a running surface of the rolling body and the running limb cooperating therewith are always aligned in a parallel relationship to one another.

The first limb portion and the second limb portion, in the mounted condition, can be spaced from each other in a height direction. Alternatively, it is also possible that the second limb portion, in the mounted condition, protrudes transversely from the first limb portion. Thereby, the second limb portion of the carcass rail, in an unloaded condition of the drawer pull-out guide, is spaced from the transverse limb of the fastening portion by the formation of a gap, preferably in a parallel or in a transverse relationship.

In an unloaded condition of the extension rail, the running limb and the rolling body adopt a zero position to one another. Upon a deviation of the zero position, caused by a loading of the extension rail, a resetting force can be applied to the carcass rail in a direction of the zero position by the arrangement of a force storage member. The force storage member can either be formed by a mechanical spring element, by an elastically yielding plastic material, and/or by an intrinsic elasticity of the carcass rail.

BRIEF DESCRIPTION OF THE DRAWINGS

Further details and advantages of the invention result from the following description of figures, in which.

DETAILED DESCRIPTION OF THE INVENTION

Figure 1:
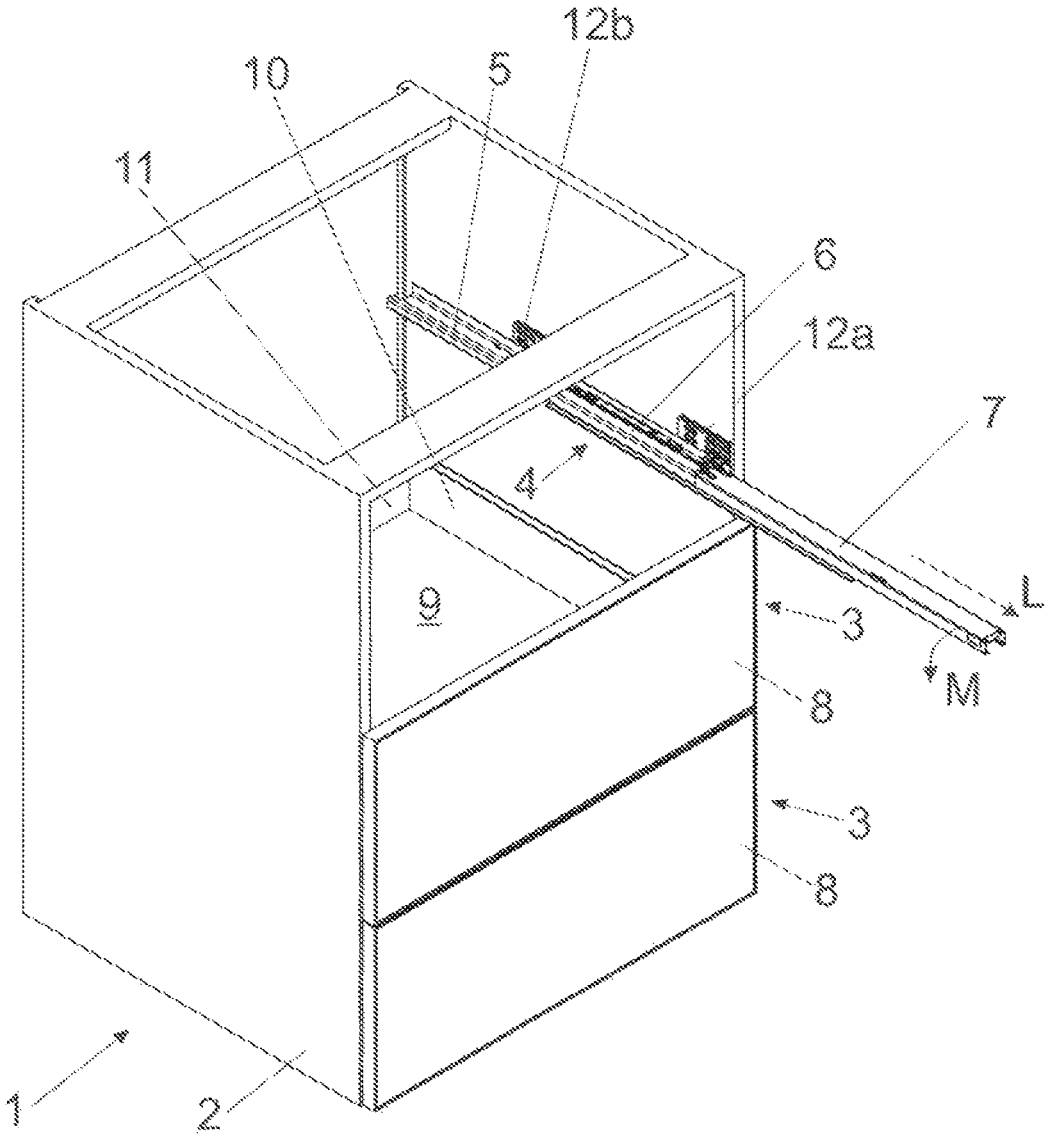
FIG. 1 shows an item of furniture with drawers which are displaceably supported relative to a furniture carcass by drawer pull-out guides.

FIG. 1 shows an item of furniture 1 having a plurality of drawers 3 which are displaceably supported in a longitudinal direction (L) by drawer pull-out guides 4 relative to a cupboard-shaped furniture carcass 2. Each of the drawer pull-out guides 4 includes a carcass rail 5 to be fixed to the furniture carcass 2, an extension rail 7 to be fixed to the drawer 3 and, if appropriate, a central rail 6 displaceable between the carcass rail 5 and the extension rail 7. Connected to the carcass rail 5 is at least one fastening portion 12*a* by which the drawer pull-out guide 4 can be fixed to the furniture carcass 2. In the shown embodiment, two fastening portions 12*a*, 12*b* are provided configured so as to be separate from each other and which are spaced from each other in the longitudinal direction (L). Each of a length of the fastening portions 12*a*, 12*b* can extend only over a partial region, preferably less than a fourth, of a length of the carcass rail 5. Each of the drawers 3 has a front panel 8, a drawer bottom 9, side walls 10 and a rear wall 11. The side wall 10 is thereby rigidly connected, i.e. axially non-displaceable, to the extension rail 7, so that the side wall 10 is configured to be jointly displaced together with the extension rail 7 upon a sliding movement of the drawer 3. Problematic issues are loads of the extension rail 7 extending transversely to the longitudinal direction (L), whereby the extension rail 7 is bent about an axis extending in the longitudinal direction (L) and is tilted in a direction of the depicted arrow (M). This lateral tilting of the extension rail 7 can lead to an uneven loading or even to a breakage of the rolling bodies 21*a*, 21*b*, 21*c* (FIG. 3) which are arranged between the carcass rail 5 and the central rail 6 and/or between the central rail 6 and the extension rail 7.

Figure 2:
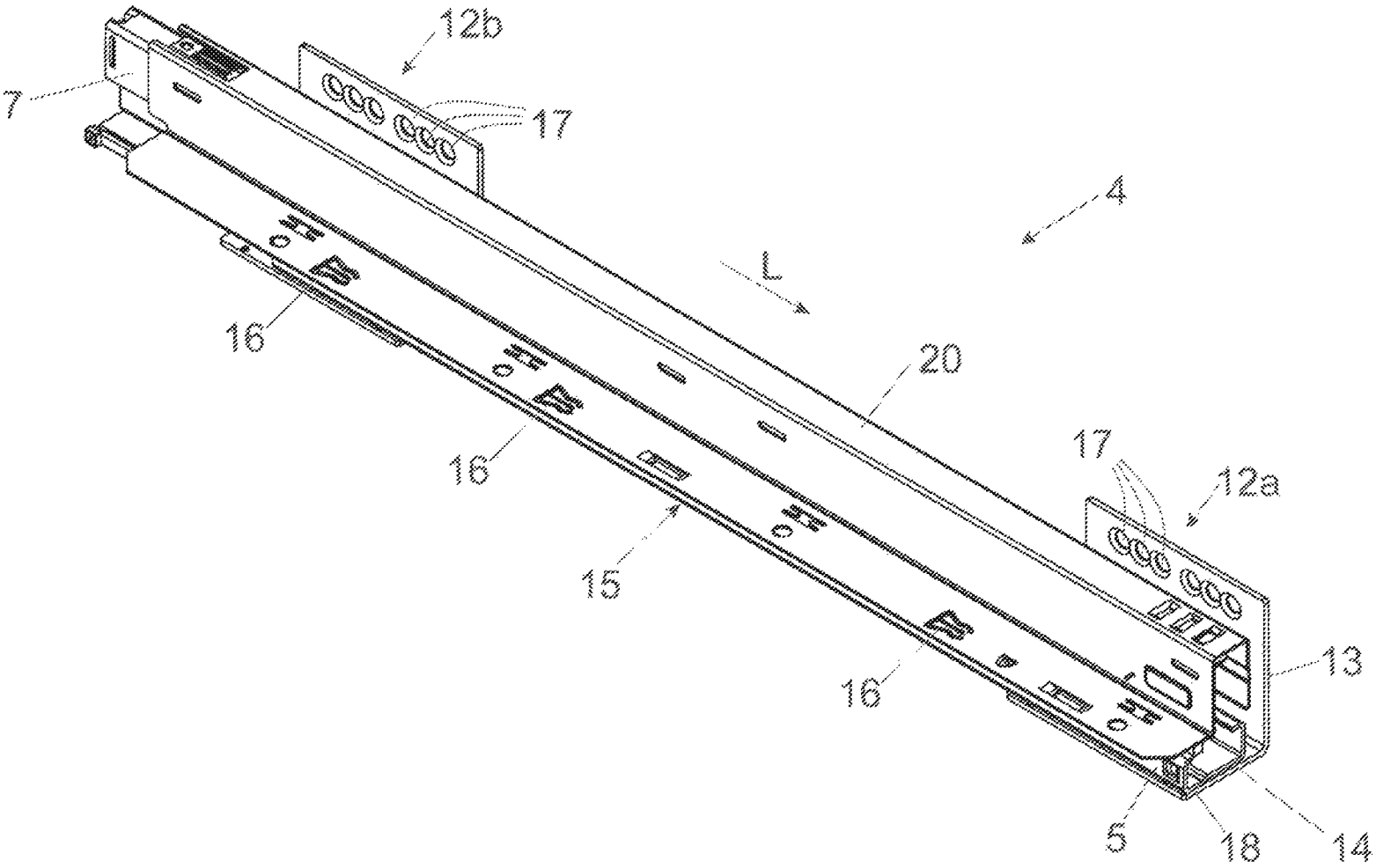
FIG. 2 is a perspective view of the drawer pull-out guide.

FIG. 2 shows the drawer pull-out guide 4 in a perspective view. The at least one fastening portion 12*a* includes a vertical limb 13 having bores 17 for fastening to the furniture carcass 2, and a transverse limb 14 protruding, preferably at a right angle, from the vertical limb 13. The transverse limb 14 of the fastening portion 12*a* is connected to a limb 18 of the carcass rail 5, the limb 18 extending in a longitudinal direction (L) of the carcass rail 5. In the shown embodiment, the extension rail 7 is connected to a carrier rail 20 to be fixed to the drawer 3. It is preferably provided that the carrier rail 20 is pre-mounted to the drawer 3, and the carrier rail 20 is arranged, in the mounted condition, so as to be non-displaceable in an axial direction relative to the extension rail 7. The connection between the extension rail 7 and the carrier rail 20 can be effected by a coupling device which is commonly known in the art, so that the carrier rail 20 (and therewith the drawer 3 in its entirety) can be releasably coupled to the extension rail 7. The carrier rail 20 includes a support portion 15 for the drawer bottom 9. In the shown embodiment, the support portion 15 is configured as a horizontal limb having a plurality of tabs 16 spaced from each other in the longitudinal direction (L), and the tabs 16 can be pressed against an underside of the drawer bottom 9 so that the drawer bottom 9 can be fixed in a force-locking manner.

Figure 3:
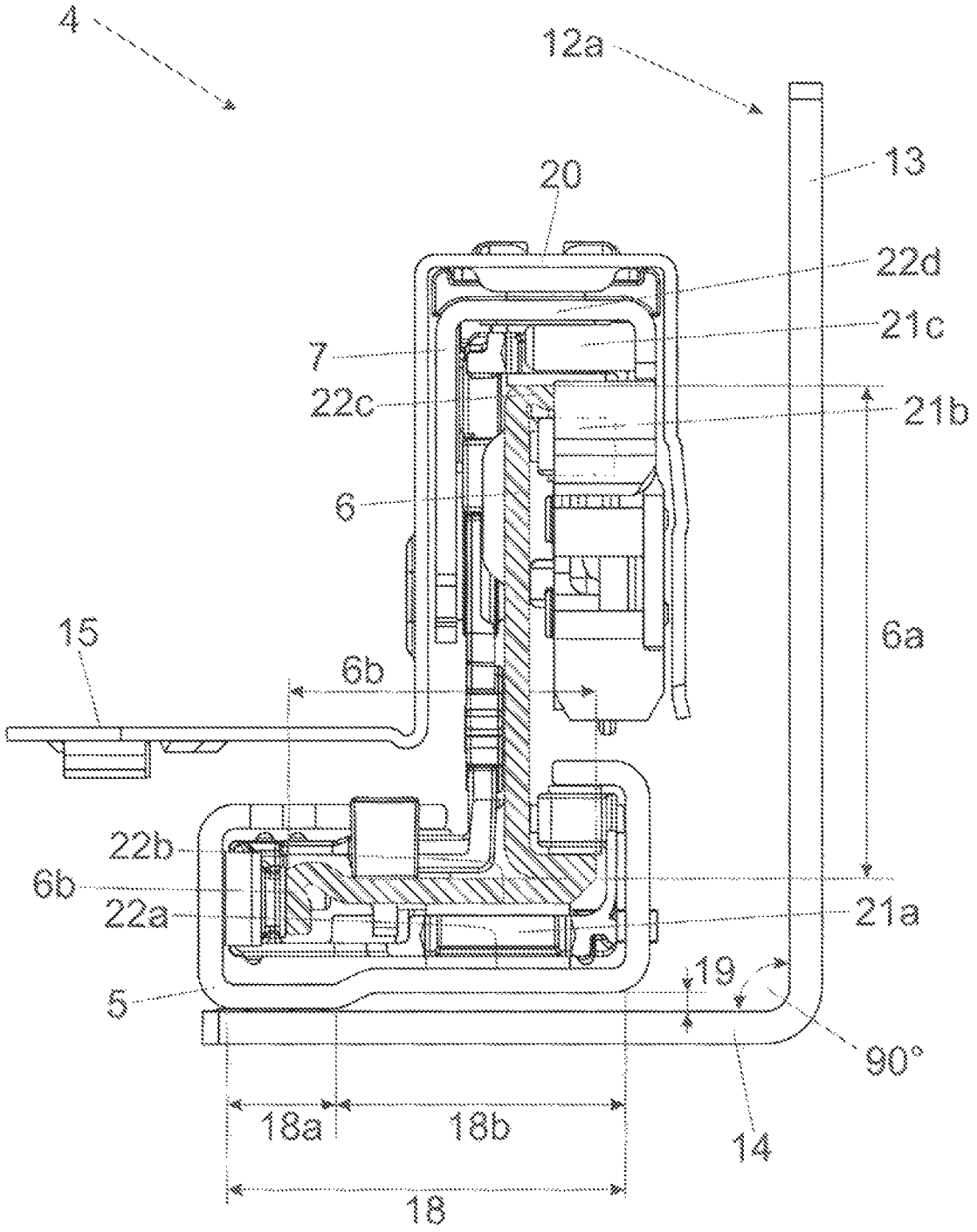
FIG. 3 shows the unloaded drawer pull-out guide in a cross sectional view.

FIG. 3 shows the unloaded drawer pull-out guide 4 in a cross sectional view. The fastening portion 12*a* includes a vertical limb 13 for resting against the furniture carcass 2 and a transverse limb 14 protruding from the vertical limb 13 at an angle of 90°. The carcass rail 5 includes a substantially C-shaped portion with a limb 18 extending in a longitudinal direction (L), the limb 18 has a first limb portion 18*a* connected to the transverse limb 14 and a second limb portion 18*b* connected to the first limb portion 18*a*, and the second limb portion 18*b* is spaced from the transverse limb 14 of the fastening portion 12*a* by the formation of a gap 19. The first limb portion 18*a* and the second limb portion 18*b*, in the mounted condition, can be spaced from each other in a height direction, for example in a parallel relationship. Alternatively, it is also possible that the second limb portion 18*b*, in the mounted condition, protrudes transversely from the first limb portion 18*a*. The central rail 6 (depicted in a hatched pattern) is displaceably supported relative to the carcass rail 5 by at least one rolling body 21*a* configured to be supported and/or to configured run along a first running limb 22*a* of the carcass rail 5 and on a second running limb 22*b* of the central rail 6. The central rail 6 includes a vertically extending side limb 6*a* arranged laterally besides the support portion 15, and a horizontally extending transverse limb 6*b* connected to the side limb 6*a*, and the transverse limb 6*b* at least partially protrudes below the support portion 15 for the drawer bottom 9. By the transverse limb 6*b* of the carcass rail 6 located below the support portion 15, a weight force of the drawer 3, in the mounted condition, can be introduced into the central rail 6 with a reduced lateral operating distance, whereby—in particular when the drawer 3 is heavily loaded—a reduced tilting moment is exerted on the drawer pull-out guide 4. By a second rolling body 21*b* configured to run along a running limb 22*c* of the central rail 6, and by a third rolling body 21*c* configured to be supported on the running limb 22*c* of the central rail 6 on the one hand and along a running limb 22*d* of the extension rail 7 on the other hand, the extension rail 7 is displaceably supported relative to the central rail 6. Each of the rolling bodies 21*a*, 21*b*, 21*c* can be arranged in a running carriage configured to be displaced between the carcass rail 5 and the central rail 6 and/or between the central rail 6 and the extension rail 7.

Figure 4:
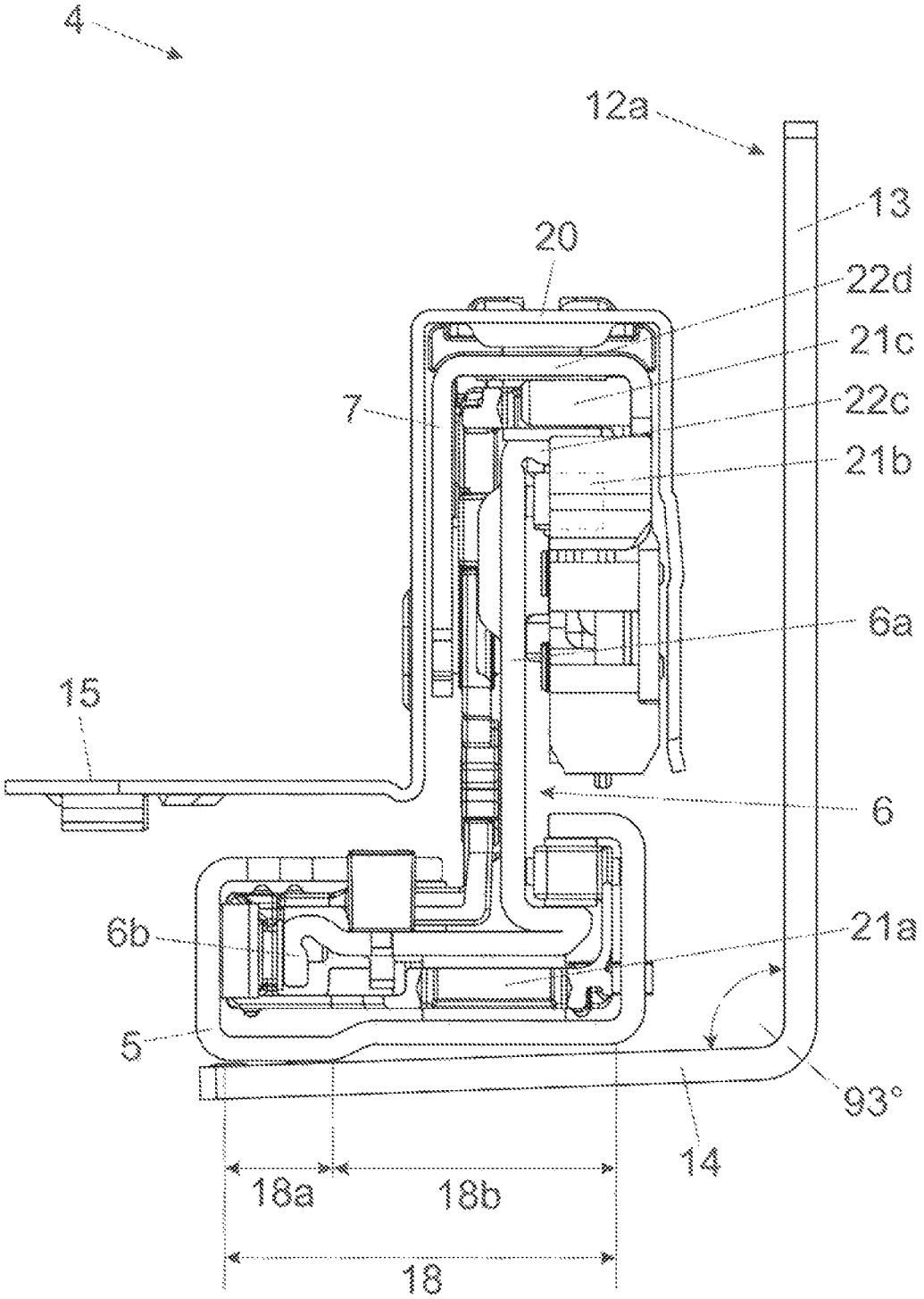
FIG. 4 shows the drawer pull-out guide loaded by stored items in a cross sectional view.

FIG. 4 shows the loaded drawer pull-out guide 4 in a cross sectional view. Due to the loading of the drawer bottom 9 with storage items, the transverse limb 14 of the fastening portion 12*a* is bent downwardly and now adopts an angle of exemplary 93° relative to the vertical limb 13. The first limb portion 18*a* is connected to the transverse limb 14 of the fastening portion 12*a*, the second limb portion 18*b*, on the contrary, is tilted or bent about an axis extending in the longitudinal direction (L) by the loading of the extension rail 7, so that a change of the relative position between the running limbs 22*a*, 22*b*, 22*c*, 22*d* and the rolling bodies 21*a*, 21*b*, 21*c* in a direction transverse to the longitudinal direction (L), caused by a loading of the extension rail 7, can be at least partially compensated. In this way, despite a deflection of the transverse limb 14 in a downward direction, a relative position between the carcass rail 5, the central rail 6, the extension rail 7 and the carrier rail 20, as well as a relative position between the rolling bodies 21*a*, 21*b*, 21*c* and the associated running limbs 22*a*, 22*b*, 22*c*, 22*d* is not altered. The rolling bodies 21*a*, 21*b*, 21*c* are evenly loaded, despite an additional load of the drawer 3 with storage items, and are therefore not subjected to uneven strain which could lead to an irregular wear or to a breakage of the rolling bodies 21*a*, 21*b*, 21*c*.

Figure 5A:
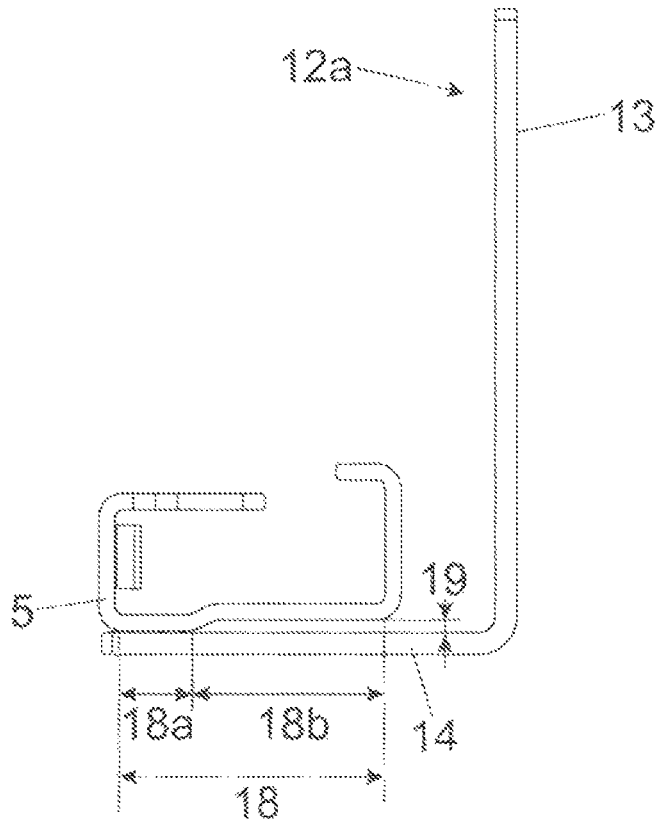
FIG. 5*a*, 5*b* are simplified views of the unloaded and the loaded condition of the drawer pull-out guide.
Figure 5B:
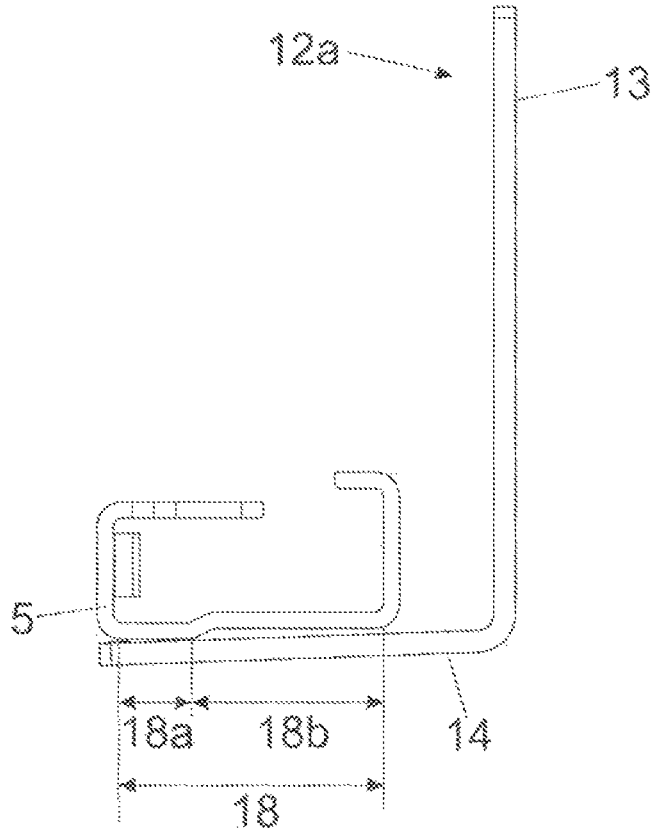

FIG. 5*a* shows a simplified view of the unloaded condition of the drawer pull-out guide 4 which corresponds to the view according to FIG. 3. The first limb portion 18*a* of the carcass rail 5 is connected to the transverse limb 14 of the fastening portion 12*a*, the second limb portion 18*b* of the carcass rail 5 is spaced, preferably in a parallel relationship, relative to the transverse limb 14 by the formation of a gap 19. When the drawer 3 is loaded, the second limb portion 18*b* is tilted or bent in a direction of the transverse limb 14, and the size of the gap 19 located between the transverse limb 14 and the second limb portion 18*b* is reduced (see FIG. 5*b* which corresponds to the view according to FIG. 4). By the loading with storage items, only the position of the second limb portion 18*b* relative to the transverse limb 14 is altered. However, the relative position of the rails to one another (and therewith the position of the rolling bodies 21*a*, 21*b*, 21*c* and the running limbs 22*a*, 22*b*, 22*c*, 22*d* to one another) can be maintained.

Figure 6:
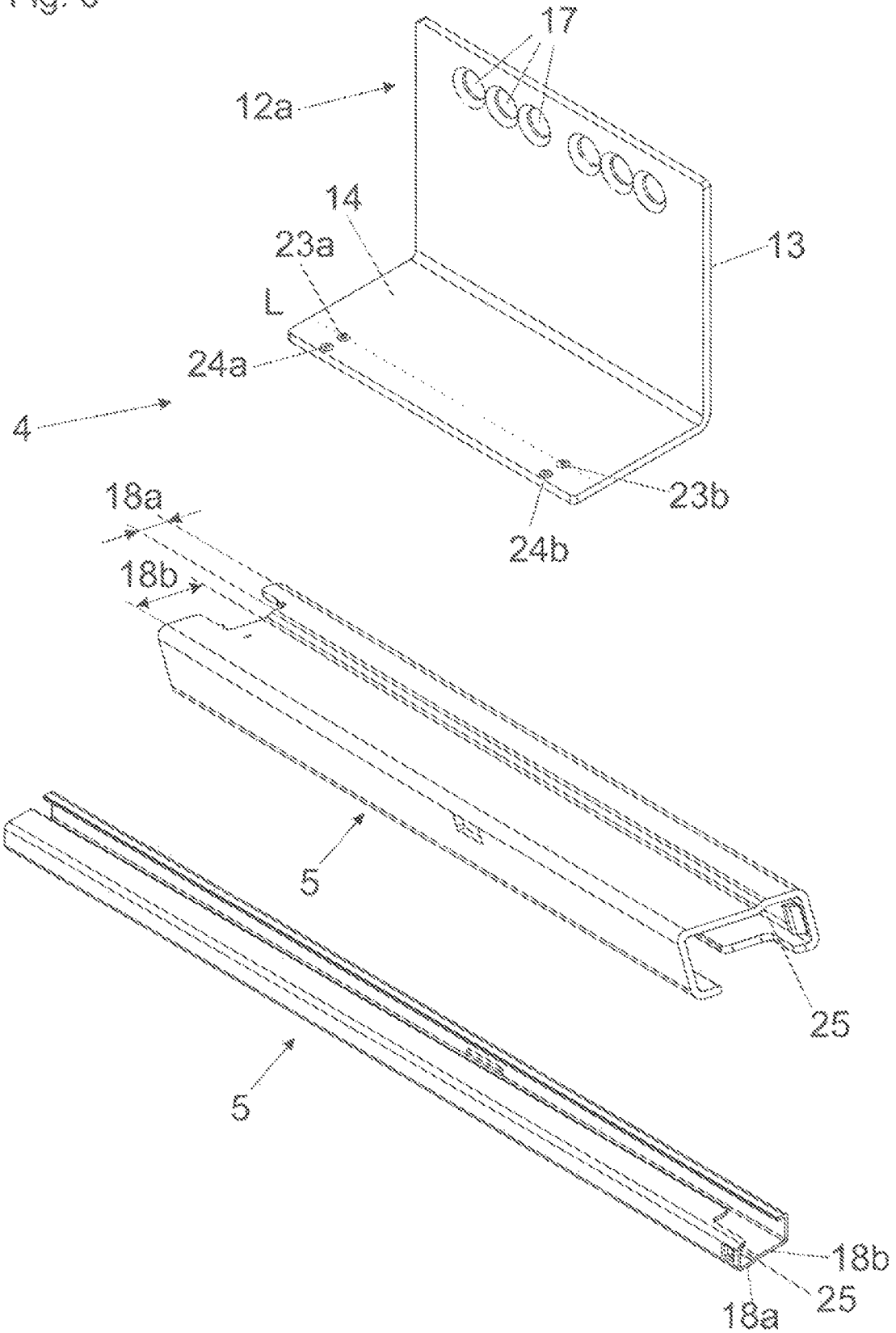
FIG. 6 shows portions of the drawer pull-out guide in a perspective view.

FIG. 6 shows the fastening portion 12*a* and the carcass rail 5 in two different perspective views. The first limb portion 18*a* of the carcass rail 5 is connected to the transverse limb 14 of the fastening portion 12*a* by at least one fastening location 23*a*. In the shown embodiment, the first limb portion 18*a* is connected to the transverse limb 14 by at least two fastening locations 23*a*, 23*b* spaced from one another in the longitudinal direction (L). This can be effected, for example, by welding, in particular laser welding. In this way, the carcass rail 5 can be tilted or bent about the longitudinal axis (L) relative to the transverse limb 14 of the fastening portion 12*a*. The fastening location 23*a* and/or the fastening location 23*b* can be configured as a point support or also as a line support, and the line support extends, at least over a region, in the longitudinal direction (L). The first limb portion 18*a* can also be connected to the transverse limb 14 by at least one joint (for example a film hinge or a point hinge), so that the second limb portion 18*b* can be tilted about the longitudinal axis (L) by this joint. Moreover, support portions 24*a* and 24*b* are provided, preferably in the form of bossed elevations, on which the first limb portion 18*a* of the carcass rail 5 is loosely supported, whereby the carcass rail 5 can be tilted about the longitudinal axis (L) in an easier manner. Alternatively, the carcass rail 5 can also be welded with the support portions 24*a*, 24*b*, so that the first limb portion 18*a* is connected to the transverse limb 14 by at least two welding connections spaced from each other in a direction transverse to the longitudinal direction (L). The first limb portion 18*a* and the second limb portion 18*b* can extend substantially over an entire length of the carcass rail 5, and a width of the second limb portion 18*b* measured in a direction transverse to the longitudinal direction (L) can have at least twice of a width than the first limb portion 18*a*. The first limb portion 18*a* and the second limb portion 18*b* are connected to one another by a crank 25 of the carcass rail 5, the crank 25 extending in the longitudinal direction (L), as shown in the two shown views of the carcass rail 5.

The invention claimed is:

1. A drawer pull-out guide, comprising:

a carcass rail to be fixed to a furniture carcass, a fastening portion for fixing the carcass rail to the furniture carcass, the fastening portion has a vertical limb configured to rest against the furniture carcass and a transverse limb protruding from the vertical limb, wherein the transverse limb of the fastening portion is connected to a limb of the carcass rail, the limb of the carcass rail extending in a longitudinal direction of the carcass rail, an extension rail displaceably supported relative to the carcass rail in the longitudinal direction, a rolling body arranged between the carcass rail and the extension rail, the rolling body to be supported on a running limb of the carcass rail and/or a running limb of the extension rail, wherein the limb of the carcass rail has a first limb portion and a second limb portion, the first limb portion of the carcass rail being connected to the transverse limb of the fastening portion, and the second limb portion of the carcass rail, in an unloaded condition of the drawer pull-out guide, being spaced from the transverse limb of the fastening portion by the formation of a gap, the second limb portion being configured, upon a load of the extension rail about an axis extending in the longitudinal direction, to be tilted or bent in a direction towards the transverse limb, so that a change of the relative position between the running limb and the rolling body, caused by a load of the extension rail in a direction transverse to the longitudinal direction, is at least partially compensated for, and the size of the gap located between the second limb portion of the carcass rail and the transverse limb of the fastening portion is reduced.

2. The drawer pull-out guide according to claim 1, wherein (i) the first limb portion and the second limb portion, in a mounted condition, are spaced from each other in a height direction, or (ii) the second limb portion, in a mounted condition, protrudes transversely from the first limb portion.

3. The drawer pull-out guide according to claim 1, wherein at least one of the first limb portion and the second limb portion extends substantially over an entire length of the carcass rail.

4. The drawer pull-out guide according to claim 1, wherein the first limb portion of the carcass rail is connected to the transverse limb of the fastening portion by a fastening location.

5. The drawer pull-out guide according to claim 4, wherein the first limb portion of the carcass rail is welded to the transverse limb.

6. The drawer pull-out guide according to claim 1, wherein the second limb portion is arranged closer to the vertical limb than the first limb portion.

7. The drawer pull-out guide according to claim 1, wherein a width of the second limb portion, measured in a direction transverse to the longitudinal direction, is at least twice a width of the first limb portion.

8. The drawer pull-out guide according to claim 1, wherein the carcass rail is configured to be fixed to the furniture carcass by at least two fastening portions spaced from each other in the longitudinal direction.

9. The drawer pull-out guide according to claim 1, wherein the drawer pull-out guide has a support portion for supporting a drawer bottom.

10. The drawer pull-out guide according to claim 1, wherein the drawer pull-out guide has a central rail displaceably arranged between the carcass rail and the extension rail.

11. The drawer pull-out guide according to claim 10, wherein the central rail has a side limb arranged laterally beside a support portion for supporting a drawer bottom, and a transverse limb connected to the side limb, and the transverse limb, in a mounted position, protrudes at least partially below the support portion for the drawer bottom.

12. The drawer pull-out guide according to claim 11, wherein (i) the side limb, in a mounted position, extends substantially vertically and/or (ii) the transverse limb, in a mounted position, extends substantially horizontally.

13. A drawer comprising the drawer pull-out guide according to claim 1.

* * * * *